US012636547B2

(12) United States Patent
Kollega

(10) Patent No.: US 12,636,547 B2
(45) Date of Patent: May 26, 2026

(54) SYSTEM AND METHOD FOR DETERMINING A ROUTE OF AN OBJECT OR A PLAYER MOVING ON A SPORT FIELD

(71) Applicant: Swiss Timing Ltd, Corgémont (CH)

(72) Inventor: Alexander Kollega, Leipzig (DE)

(73) Assignee: Swiss Timing Ltd, Corgémont (CH)

( * ) Notice: Subject to any disclaimer, the term of this patent is extended or adjusted under 35 U.S.C. 154(b) by 187 days.

(21) Appl. No.: 18/498,265

(22) Filed: Oct. 31, 2023

(65) Prior Publication Data

US 2024/0165463 A1 May 23, 2024

(30) Foreign Application Priority Data

Nov. 23, 2022 (EP) ..... 22209030

(51) Int. Cl.
*A63B 24/00* (2006.01)

(52) U.S. Cl.
CPC .. *A63B 24/0021* (2013.01); *A63B 2024/0025* (2013.01); *A63B 2024/0028* (2013.01)

(58) Field of Classification Search
CPC ..... A63B 24/0021; A63B 2024/0025; A63B 2024/0028
USPC ..... 700/91
See application file for complete search history.

(56) References Cited

U.S. PATENT DOCUMENTS 10,159,888 B2 * 12/2018 Ianni ..... H04W 4/029
11,247,108 B2 * 2/2022 Vollbrecht ..... A63B 67/02
2003/0049590 A1 * 3/2003 Feldbau ..... G09B 19/0038 434/251
2003/0054905 A1 * 3/2003 King, Jr. ..... A63B 24/0021 700/91
2008/0021651 A1 * 1/2008 Seeley ..... A63B 24/0021 702/152
2008/0207357 A1 8/2008 Savarese et al.
2010/0088023 A1 4/2010 Werner
2017/0007882 A1 1/2017 Werner
2019/0377345 A1 12/2019 Bachrach et al.
2022/0268932 A1 8/2022 Forsberg
2022/0374012 A1 11/2022 Bachrach et al.
2022/0374013 A1 11/2022 Bachrach et al.

OTHER PUBLICATIONS

European Search Report issued Mar. 29, 2023 in European Application 22209030.0 filed on Nov. 23, 2022, 9 pages.

* cited by examiner

*Primary Examiner* — Allen Chan
(74) *Attorney, Agent, or Firm* — Oblon, McClelland, Maier & Neustadt, L.L.P.

(57) ABSTRACT

A method for determining a route of an object or of a player moving on a sport field, this route being constituted solely of stationary positions of this object or of this player on this sport field, the method including a step of determining by a portable electronic device geographical position "X"_"Ball" "Y"_"Ball") data of the object or of the player during a sporting activity only when the object or the player is in a stationary position on the sport field, and a step of generating the route of the object or of the player on a graphical representation of the sport field based on the geographical position data ("X"_"Ball", "Y"_"Ball") calculated by the electronic device.

13 Claims, 1 Drawing Sheet

SYSTEM AND METHOD FOR DETERMINING A ROUTE OF AN OBJECT OR A PLAYER MOVING ON A SPORT FIELD

CROSS-REFERENCE TO RELATED APPLICATION

This application claims priority to European Patent Application No. 22209030.0 filed on Nov. 23, 2022, the entire disclosure of which is hereby incorporated herein by reference.

FIELD OF THE INVENTION

The present invention relates to a system and method for determining a route of an object or a player moving on a sport field.

BACKGROUND OF THE INVENTION

There are many sports in which it can be interesting to have the path followed by an object or a player moving on a sports field. We can cite for example sports such as curling, petanque, snooker, or even golf.

In the prior art, it is known that the determination of such a route is generally realised based on a system which is able to implement complex monitoring facility making it possible to locate in real time the position of the object or the player on the sport field. Such a monitoring facility used high-precision laser distance measuring systems installed at several locations on the sport field. Such a system requires a high number of skilled operators to ensure the operability of the monitoring facility.

In this context, there is a need for an improved system and method for determining a route of an object or of a player moving on a sport field, that overcome the mentioned disadvantage.

SUMMARY OF THE INVENTION

Embodiments of the present disclosure provide an alternative to the existing methods.

To this end, embodiments of the present disclosure include a method for determining a route of an object or of a player moving on a sport field, this route being constituted solely of stationary positions of this object or of this player on this sport field, the method comprising:

- a step of determining by a portable electronic device geographical position data of the object or of the player during a sporting activity only when the object or the player is in a stationary position on the sport field, and
- a step of generating the route of the object or of the player on a graphical representation of the sport field based on the geographical position data calculated by the electronic device.

In other embodiments:

- the step of determining comprises a sub-step of detecting that the object or the player is in a stationary position on the sport field;
- the step of determining comprises a sub-step of estimating characteristics of determination of the geographical position data of the object or of the player during the sporting activity;
- the sub-step of estimating comprises a phase of measurement of a distance between the object or the player, and the electronic device;

- the sub-step of estimating comprises a phase of evaluating an angle $\alpha$ of deviation from a main direction of movement of the object or the player;
- the sub-step of estimating comprises a phase of determining geographical position of the electronic device;
- the step of determining comprises a sub-step of calculating the position data of the object or of the player based on an angle estimated between a direction oriented towards the object or the player and a direction oriented towards a cardinal point;
- the step of determining comprises a sub-step of calculating the position data of the object or of the player based on a distance evaluated between the object or the player and the electronic device;
- the step of determining comprises a sub-step of calculating the position data of the object or of the player based on a geographical position of the electronic device;
- the sub-step of calculating comprises a phase of executing an algorithm of production of the position data implementing the mathematical formulas:

$$X_{Ball}=X_{Ped}+d\cdot\sin(\alpha)$$

$$Y_{Ball}=Y_{Ped}+d\cdot\cos(\alpha)$$

- the step of generating comprises a sub-step of selecting a geographical map data relating to the sport field;
- the step of generating comprises a sub-step of creating the route on the graphical representation of the sport field based on the geographical position data determined and the geographical map data.

Embodiments of the present disclosure also include a system for determining a route of an object or of a player moving on a sport field, this route being constituted of stationary positions of this object or of this player on this sport field, the system comprising an electronic device configured for:

- determining geographical position data of the object or of the player during a sporting activity each time the object or of the player is in a stationary position on the sport field, and
- generating the route of the object or of the player on a graphical representation of the sport field based on the geographical position data.

In other embodiments:

- the electronic device is a portable electronic device such as a smartphone, a smartwatch, a phablet or a tablet;
- the electronic device is a movable electronic device which can be moved autonomously or by being remotely controlled by a remote server or an operator.

Embodiments of the present disclosure also include a non-transitory computer-readable medium storing computer instructions configured to cause at least one processor of an electronic device to:

- determining geographical position data of the object or of the player during a sporting activity each time the object or of the player is in a stationary position on the sport field, and
- generating the route of the object or of the player on a graphical representation of the sport field based on the geographical position data.

Embodiments of the present disclosure also include a computer program, optionally stored on a medium, comprising instructions for causing an electronic device and/or a server to perform this method.

BRIEF DESCRIPTION OF THE DRAWINGS

The present invention will be described subsequently in more detail with reference to the attached drawing, given by way of examples, but in no way limited thereto, in which.

DETAILED DESCRIPTION OF THE INVENTION

Figure 1:
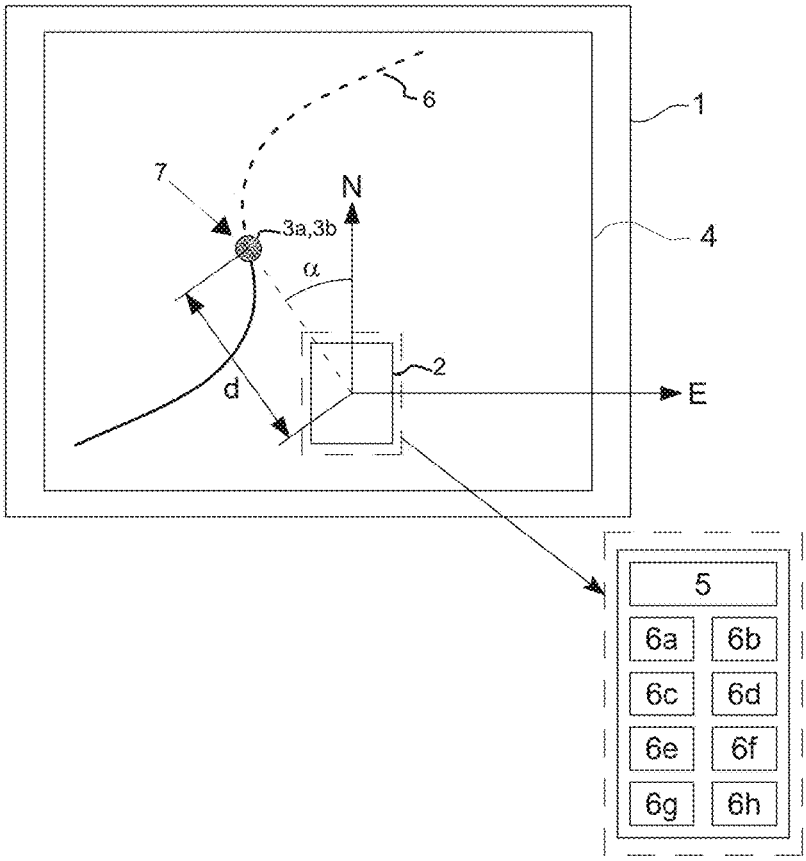
FIG. 1 a schematic diagram illustrating view of a system for determining a route of an object or a player moving on a sport field, according to an embodiment of the invention.
Figure 2:
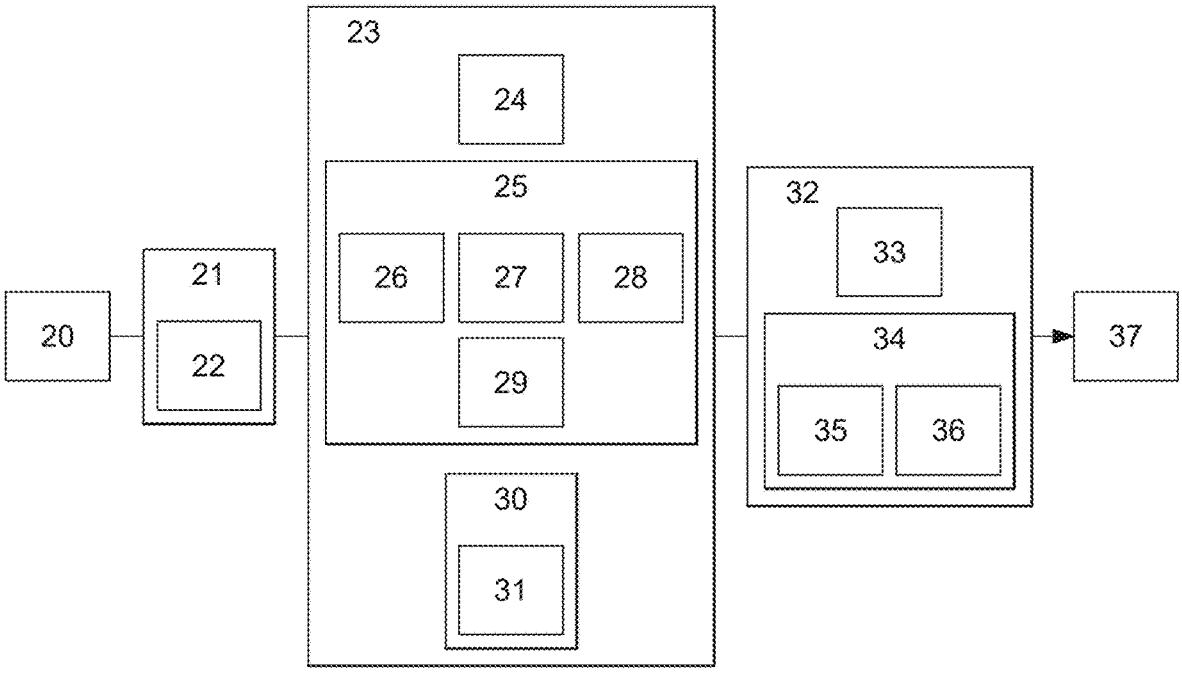
FIG. 2 represents a flowchart related to a method for determining the route of the object or the player moving on the sport field, according to the embodiment of the invention.

With reference to FIGS. 1 and 2, a system 1 and a method for determining a route 6 of an object 3*a* or a player 3*b* moving on a sport field 4 is illustrated. In this context, it can be understood that such a system 1 and such a method can also permit to monitor the progress of the object 3*a* or the player 3*b*, on the sport field 4. In other word, these system 1 and method contribute to inform visually the audience of a sport game about of the route 6 and more particularly about the last position of the object 3*a* or the player 3*b* on the sport field 4.

Such a system 1 and method can be implemented in every sports in which the object 3*a* or the player 3*b* is brought to move on a sport field 4 by marking frequent stops. These sport can be in a non-limiting and/or non-exhaustive manner: the golf, the petanque or the curling, etc. . . . . In this regard, the object 3*a* is a mobile object like for example a ball, a slide stone etc. . . .

In this context, the frequent stops correspond in this invention to stationary positions 7 of the object 3*a* or of the player 3*b* on the sport field 4. It must be understood that the stationary position 7 means that the object 3*a* or the player 3*b* stays without moving/displacing for a period of time during the sporting activity on this sport field 4.

In the context of the invention, the object is a moving object more specifically a mobile sports object which is obviously used in the field of sport. More precisely, this object is an ordinary object, i.e. an object that has not been modified with respect to the original object known to be used in the sport concerned. In other words, if this object is a golf ball, then it is the ball classically used in this sport and not a ball that has been modified to include, for example, an electronic device such as a tag RFID. This objet can also be an inert object, i.e. one that has no activity (e.g. does not generate an electromagnetic field) or movement of its own (as it requires to be set in motion by the application of a force to it).

In FIG. 1, this system 1 includes an electronic device 2 which is preferably a portable electronic device or a mobile electronic device that is to say a battery operated device designed to be carried including but not limited to equipment such as laptops, tablets computers, smart phones, smart watches and the like.

This electronic device 2 can be also called "movable electronic device" as it is configured to follow the object 3*a* or the player 3*b*. Indeed, this electronic device 2 can move autonomously by including a transport module which can be removable transport module. In this configuration, this device 2 can be a rolling movable electronic device like a radio-controlled car for example a miniature model car, van or buggies that can be controlled from a distance using a specialized transmitter or remote. As a variant, this device 2 can be a flying movable electronic device like a drone.

It can be noted that when this device 2 is a movable electronic device, it can also be moved by being remotely controlled by a remote control device of this system 1. In this context, this remote control device is connected to the device 2 and can thus control the movement of the device 2 in order to follow the displacement of the object 3*a* or the player 3*b* on the sport field 4. The remote control device comprised a control unit which is able to execute a specific algorithm to control the autonomous displacement of the electronic device 2. In a variant, this remote control device comprises for controlling the movement of the electronic device 2 which can be used/manipulated by an operator. It can be noted that this operator can be located in a different place of the object 3*a* or the player 3*b*.

Such an electronic device 2 comprises in a non-limiting and/or non-exhaustive manner:

- a processing unit 5 (also referred to as a "controller") including hardware 6*a* and software resources 6*b*, in particular at least one processor cooperating with memory elements;
- a distance measurement module 6*c* between the electronic device and the object or the player;
- a geolocation receiver 6*d* suitable for use with a Global Navigation Satellite System ("GNSS") such as the Global Positioning System ("GPS");
- an interface for broadcasting a visual information 6*e* such as a digital display;
- an interface for broadcasting an audio information 6*f* such as a loudspeaker;
- a communication interface 6*g* allowing this device 2 to establish a communication connection with a remote server (for example cellular, WLAN Bluetooth, etc.);
- an input interface 6*h* as a button, a touch interface comprised in, for example, the interface for broadcasting a visual piece of information, or a microphone for voice commands.

In this device 2, the processing unit 5 is connected, inter alia, to the distance measurement module 6*c* and the geolocation receiver 6*d*, the interfaces for broadcasting 6*e*, 6*f*, the communication interface 6*g* and the input interface 6*h*.

It should be noted that this electronic device 2 is preferably not equipped with an image capture module, as such a module is not part of the embodiment of the invention described here especially for the implementation of a phase of measurement 26 of the distance d between the object 3*a* or the player 3*b*, and the electronic device 2 discussed in this description.

More specifically, the distance measurement module 6*c* comprises:

- a module of telemetering including an electronic telemeter, a module of telemetering, an ultrasonic rangefinder and/or a laser rangefinder;
- an active remote sensing system like for example a LIDAR acronym for "Light Detection And Ranging";
- a pedometer-type motion sensor.

It can be noted that the distance measurement module 6*c* is dedicated for measuring the distance between the electronic device and the object or the player. In other words, this module 6*c* measures this distance and transmits it to the processing unit 5 of this electronic device 2 for example to store it in an element memory of this unit 5 in order to generate a route at a later date. It is to be understood here that the electronic device 2 and more particularly the processing unit 5 is not configured to obtain this measurement in any other way. That is to say, the electronic device 2 and more particularly the processing unit 5 is not configured to obtain this distance by implementing, for example, calculations to determine (and not measure) such a distance. In this context, these calculations can be implemented, for example, when digitally processing an image including the object or player with the electronic device to determine this distance.

Moreover, the communication interface 6*g* of this device 2 includes communication elements for receiving and transmitting data remotely via a communication network such as the cellular telephone network, a data network of the IP type via the telephone network, or a data network of the IP type via a medium-range network, for example WI-FI or a short-range network implementing Bluetooth technology.

Furthermore, the processing unit 5 of this electronic device 2 is able to execute a computer program also called an application or "apps". More precisely in this context, the application is an "application for positioning the ball". This application is able to participate in the implementation of a part of the steps 20 to 37 of the method described below, when the processing unit 5 of the device 2 executes it.

Referring now to FIG. 2, the system 1 is capable of implementing the method for determining a route 6 of the object 3*a* or of the player 3*b* moving on a sport field 4, this route 6 being constituted of stationary positions 7 of this object 3*a* or of this player 3*b* on this sport field 4.

Such a method starts with a step of executing 20 by the processing unit 5 of the device 2, the application for positioning the object 3*a* or the player 3*b*. By thus executing this application, this processing unit 5 is able to implement the followings steps of the method in order to participate to the determination of this route 6 of the object 3*a* or the player 3*b* moving on the sport field 4.

Once this application is executed by the processing unit 5, the method includes a step of arranging/positioning 21 of the electronic device 2 at a distance d of the object 3*a* or of the player 3*b*. During this step 21, the device 2 is arranged in the vicinity of this object 3*a* or of this player 3*b*, that is to say not being in contact with this object 3*a* or with this player 3*b*. In other words, the distance d established between the device 2 and, this object 3*a* or this player 3*b* is not null. More specifically, this distance is comprised between 1 and 10 meters. This distance d is preferably in the order of 4 meters.

More specifically, this step 21 comprises a sub-step of following 22 the object 3*a* or the player 3*b*. During this sub-step 22, the device 2 can be carried and manipulated/controlled by an accompanying person of the player 3*b* or of the object 3*a*. In this context, this sub-step 22 can comprise a phase of guiding visually and/or audibly this person via the interface for broadcasting 6*e* a visual guidance information/message and/or the interface for broadcasting 6*f* an audio guidance information/message of the device 2. Such a phase of guiding is implemented by the processing unit 5 connected to these two interfaces 6*e*, 6*f*. In an alternative, when the device 2 comprises a transport module, this device 2 can follow the player 3*b* or the object 3*a* autonomously or by being controlled remotely by the operator mentioned previously.

Furthermore, the method includes a step of determining 23 by the electronic device 2, geographical position $X_{Ball}$>, $Y_{Ball}$ data of the object 3*a* or of the player 3*b* during the sporting activity. Such a step 23 is implemented by the processing unit 5 of the device 2 executing the application for positioning the object 3*a* or the player 3*b*.

This step 23 includes a sub-step of detecting 24 that the object 3*a* or the player 3*b* is in a stationary position 7. Indeed, the determination of geographical position $X_{Ball}$, $Y_{Ball}$ data requires that the object 3*a* or the player 3*b* be in a stationary/immobile position on the sport field 4. Such a sub-step 24 is suitable to detect that this object 3*a* or player 3*b* is in a stationary position 7 after the processing unit 5 of the device 2 has determined that this object 3*a* or player 3*b* has remained immobile for a time t greater than a configurable reference time.

Then, this step 24 comprises a sub-step of estimating 25 characteristics of determination of the geographical position data $X_{Ball}$, $Y_{Ball}$ of the object 3*a* or of the player 3*b* during the sporting activity.

During this sub-step 25, the device 2, more specifically its processing unit 5, is able to implement various measurement operations in order to determine the positions of the object 3*a* or of the player 3*b*. To achieve this, the device 2 performs the following phases simultaneously, or successively in any order:

- a phase of measurement 26 of the distance d between the object 3*a* or the player 3*b*, and the electronic device 2;
- a phase of determining 27 geographical position $X_{Ped}$, $Y_{Ped}$ of the electronic device 2, and
- a phase of evaluating 28 of an angle α of deviation from main direction of movement.

In this context, the processing unit 5 by executing this application is configured to participate in the implementation of the phase of measurement 26 of the distance d. More specifically, this phase 26 comprises:

- orientation of the electronic device 2 towards the object or player;
- activation of the distance measurement module 6 that is to say, an activation of the module of telemetering, the active remote sensing system, and/or the pedometer-type motion sensor;
- triggering the measurement of this distance;
- transmission of a measurement data to the processing unit 5.

During this phase 26, this processing unit 5 receives measurement data from the distance measurement module 6*c*. This measurement data relating to the distance d between the device 2 and, the object 3*a* or the player 3*b*, is then stored in the memory elements of the processing unit 5. It may be noted that this phase 26 is a measurement phase and not a determination or evaluation phase of the distance between the object 3*a* or player 3*b* and the electronic device 2. This is because evaluation or determination, unlike simple measurement, involves energy-intensive calculation and processing processes.

In an alternative, the distance d can be a predetermined distance, or a distance already known because this distance d is for instance always the same. In this context, this distance d is already stored in the form of measurement data in the memory elements of the processing unit 5.

In another variant, this distance d can be entered from the input interface by a user of this device 2 or an operator of this device 2. In this case, the processing unit 5 receives a measurement data relating to this distance from the input interface.

Furthermore, the processing unit 5 by executing this application is also configured to participate to implement the phase of determining 27 geographical position $X_{Ped}$, $Y_{Ped}$, of the device 2. More specifically, the processing unit 5 receives measurement data from the geolocation receiver of this device 2. This measurement data includes preferably information relating to geographical position of the device 2 also known as geopositioning, geotracking, geolocalization, geolocating, geolocation, or geoposition fixing. This geographical position $X_{Ped}$, $Y_{Ped}$ yields a set of geographic coordinates such as latitude and longitude in a given map datum.

Additionally, the processing unit 5 executing this application is also configured to participate to the phase of evaluating 28 of the angle α of deviation from main direction of movement. This angle α is defined between a stationary position direction and the main direction of movement. This stationary position direction is a direction oriented towards the object 3*a* or the player 3*b* when it is in a stationary position. In other words, this direction is defined between the electronic device 2 and the object 3*a* or the player 3*b*. Regarding the main direction, it relates to the dominant or general direction of the object 3*a* or the player 3*b* 3*b* when it is in a stationary position, this direction is defined here by the cardinal points more specifically by the four cardinal points: north, south, east, west. In this context, this phase of evaluating 28 includes identification of this main direction of movement of the object 3*a* or the player 3*b*. This identification involves selecting one of the four cardinal points with which the stationary position direction forms the smallest angle. Once the main direction has been identified, the deviation between this main direction and the stationary position direction is calculated in order to obtain the angle α of deviation from main direction of movement.

This phase 28 is implemented by the processing unit 5 receiving measurement data from one or several of the following sensors of the device 2, such as the acceleration sensor and/or the magnetic sensor and/or the G-sensor and/or the gyroscope sensor and/or the motion sensor. This measurement data relating to the angle α, is then stored in the memory elements of the processing unit 5.

It can be noted that, this a sub-step of estimating 25 comprises a phase of following 29 the object 3*a* or the player 3*b*. Such a phase 29 can be executed simultaneously to the other phases 26 to 28 of this sub-step 25. This phase 29 participates to the realisation of the different measuring operations in order to determine the geographical position data $X_{Ball}$, $Y_{Ball}$ of the object 3*a* or of the player 3*b*.

During this phase 29, the device 2 can be carried and manipulated/controlled by an accompanying person of the player 3*b* or of the object 3*a*. In this context, this phase 29 can comprise a sub-phase of guiding visually and/or audibly this person via the interface for broadcasting 6*e* a visual guidance information/message and/or the interface for broadcasting 6*f* an audio guidance information/message of the device 2. Such a sub-phase of guiding is implemented by the processing unit 5 connected to these two interfaces 6*e*, 6*f*. In an alternative, when the device 2 comprises a transport module, this device 2 can follow the player 3*b* or the object 3*a* autonomously or by being controlled remotely by the operator mentioned previously.

Then, the step of determining 23 includes a sub-step of calculating 30 the position data $X_{Ball}$, $Y_{Ball}$ of the object 3*a* or the player 3*b* by the electronic device 2, more specifically by its processing unit 5. This sub-step 30 comprises a phase of executing 31 an algorithm of production of the position data $X_{Ball}$, $Y_{Ball}$ based on the following data measurements stored in the memory elements of the processing unit 5, namely:

- the angle α between the direction oriented towards the object 3*a* or the player 3*b*, and the direction oriented towards a cardinal point;
- the distance d between the object 3*a* or of the player 3*b*, and the electronic device 2, and
- the geographical position $X_{Ped}$, $Y_{Ped}$ of the electronic device 2.

In this context, the algorithm of production of the position data $X_{Ball}$, $Y_{Ball}$ comprises the mathematical formulas:

$$X_{Ball}=X_{Ped}+d\cdot\sin(\alpha)$$

$$Y_{Ball}=Y_{Ped}+d\cdot\cos(\alpha)$$

with:

- $X_{Ball}$ a geographical position component of the object 3*a* or of the player 3*b*, here geographic coordinate such as the longitude in a given map datum;
- $Y_{Ball}$ a geographical position component of the object 3*a* or of the player 3*b* here geographic coordinate such as the latitude in a given map datum;
- $X_{Ped}$ a geographical position component of the device 2 here geographic coordinate such as the longitude in a given map datum;
- $Y_{Ped}$ a geographical position component of the device 2 here geographic coordinate such as the latitude in a given map datum;
- d: the distance between the object 3*a* or the player 3*b* and the device 2;
- α: the angle between the direction oriented towards the object 3*a* or the player 3*b*, and a direction oriented towards a cardinal point.

Then, the position data $X_{Ball}$, $Y_{Ball}$ of the object 3*a* or of the player 3*b* here generated is stored in the memory elements of the processing unit 5.

Furthermore, the method comprises then a step of generating 32 the route 6 of the object 3*a* or of the player 3*b* on/in a graphical representation of the sport field 4 based on the geographical position data $X_{Ball}$, $Y_{Ball}$ calculated by the electronic device 2. It can be noted that this graphical representation can be a two-dimensional graphical representation or a three-dimensional graphical representation.

This step of generating 32 comprises a sub-step of selecting 33 a geographical map data relating to the sport field 4. This geographical cartographic data includes all the information concerning the geographical particularities of the sport field 4, respecting the topography, the distances and the reliefs of this ground. The memory element of the processing unit 5 comprises a plurality of geographical map data relating to different sports fields 4. These geographical map data relating to different sports fields 4 can also be stored in a remote server to which the device 2 is able to connect in the context of this sub-step of selecting 33.

Then this step 32 comprises a sub-step of creating 34 the route 6 on/in the graphical representation of the sport field 4 based on the geographical position data $X_{Ped}$, $Y_{Ped}$ determined and these geographical map data. This sub-step 34 includes a phase of generating 35 by the processing unit 5 of the device 2 this graphical representation based on the geographical map data previously selected.

Afterwards, the sub-step of creating 34 includes a phase of positioning 36 the stationary positions 7 on this graphical representation based on the geographical map data and the geographical position data $X_{Ped}$, $Y_{Ped}$ previously determined.

During this sub-step 34, the processing unit 5 is able to implement these two phases 35, 36 by executing instructions for implementing a graphical program for generating the graphical representation comprising the route 6 realised by the object 3*a* or the player 3*b* based on the geographical map data and the geographical position data $X_{Ped}$, $Y_{Ped}$.

The method can comprise a step of broadcasting 37 the graphical representation of the sport field 4 including this route 6 to:

- the interface for broadcasting a visual information 6*e* of the device 2, or
- to the remote server comprising a web server application or a streaming server application.

It may be noted that the step of generating 32 the route 6 is executed once all the geographical position data have been determined. That is to say when the sporting activity or the game is finished. As a variant, this step 32 can be executed for each determined geographic position datum. That is to say each time this geographical position data is obtained.

Furthermore, the present disclosure also include a non-transitory computer-readable medium storing computer instructions configured to cause at least one processor of an electronic device to:

determining geographical position data $X_{Ball}$, $Y_{Ball}$ of the object or of the player during a sporting activity each time the object or of the player is in a stationary position 7 on the sport field, and generating the route of the object or of the player on a graphical representation of the sport field based on the geographical position data $X_{Ball}$, $Y_{Ball}$.

The foregoing is only illustrative of preferred embodiments of the present invention. The present invention is not limited to the above embodiments. It should be understood that further improvements and changes that are directly derived or conceived by those skilled in the art without departing from the basic concept of the present invention should be considered to be included in the protective scope of the present invention.

The invention claimed is:

1. A method for determining a route of an object or of a player moving on a sport field, said route being constituted solely of stationary positions of said object or of said player on said sport field, the method comprising:

determining, by processing circuitry of a portable electronic device, geographical position data of the object or of the player during a sporting activity, only when the object or the player is in a stationary position on the sport field, calculating the route of the object or of the player based on the determined geographical position data:

extracting, from an electronic memory, geographical map data of the sport field;

generating a graphical representation of the sport field based on the geographical map data and graphically superimposing the calculated route of the object or of the player on the generated graphical representation of the sport field; and displaying, on a display, the generated graphical representation with the graphically superimposed route.

2. The method according to claim 1, wherein the determining step further comprises detecting that the object or the player is in a stationary position on the sport field.

3. The method according to claim 1, wherein the determining step further comprises estimating characteristics of determination of the geographical position data of the object or of the player during the sporting activity.

4. The method according to claim 3, wherein the estimating step further comprises evaluating an angle of deviation from a main direction of movement of the object or the player.

5. The method according to claim 3, wherein the estimating step further comprises measuring a distance between the object or the player, and the electronic device.

6. The method according to claim 3, wherein the estimating step further comprises determining a geographical position of the electronic device.

7. The method according to claim 1, wherein the determining step further comprises calculating the geographical position data of the object or of the player based on:

an angle estimated between a direction oriented towards the object or the player and a direction oriented towards a cardinal point;

a distance evaluated between the object or the player and the electronic device, and a geographical position of the electronic device.

8. The method according to claim 7, wherein the calculating step further comprises executing an algorithm to generate the geographical position data of the object or the player that adds, to the geographical position of the electronic device, values depending on the distance and the angle.

9. The method of claim 1, further comprising broadcasting the generated graphical representation of the sport field to a remote server having a web server application or a streaming server application.

10. A system for determining a route of an object or of a player moving on a sport field, said route being constituted of stationary positions of said object or of said player on said sport field, the system comprising an electronic device including processing circuitry configured to:

determine geographical position data of the object or of the player during a sporting activity each time the object or of the player is in a stationary position on the sport field, calculate the route of the object or of the player based on the determined geographical position data;

extract, from an electronic memory, geographical map data of the sport field;

generate a graphical representation of the sport field based on the geographical map data and graphically superimpose the calculated route of the object or of the player on the generated graphical representation of the sport field; and display, on a display, the generated graphical representation with the graphically superimposed route.

11. The system according to claim 10, wherein the electronic device is a portable electronic device such as a smartphone, a smartwatch, a phablet, or a tablet.

12. The system according to claim 10, wherein the electronic device is a movable electronic device configured to be moved autonomously or by being remotely controlled by a remote server or an operator.

13. A non-transitory computer-readable medium storing computer instructions configured to cause at least one processor of an electronic device to:

determine geographical position data of an object or of a player during a sporting activity each time the object or of the player is in a stationary position on a sport field, calculate a route of the object or of the player based on the determined geographical position data:

extract, from an electronic memory, geographical map data of the sport field;

generate a graphical representation of the sport field based on the geographical map data and graphically superimpose the calculated route of the object or of the player on the generated graphical representation of the sport field; and display, on a display, the generated graphical representation with the graphically superimposed route.

* * * * *